United States Patent [19]

Higashinaka

[11] Patent Number: 4,920,617

[45] Date of Patent: May 1, 1990

[54] SEPARABLE FASTENER

[75] Inventor: Yukitoshi Higashinaka, Iruma, Japan

[73] Assignee: Kuraray Company, Ltd., Kurashiki, Japan

[21] Appl. No.: 266,329

[22] Filed: Nov. 1, 1988

Related U.S. Application Data

[63] Continuation of Ser. No. 71,378, Jul. 9, 1987, abandoned.

[30] Foreign Application Priority Data

Jul. 30, 1986 [JP] Japan ..... 61-181154

[51] Int. Cl.[5] ..... A44B 18/00

[52] U.S. Cl. ..... 24/442; 24/446; 24/450

[58] Field of Search ..... 24/442, 446, 452, 449, 24/445, 443, 444

[56] References Cited

U.S. PATENT DOCUMENTS

| | | | |
|---|---|---|---|
| 3,405,430 | 10/1968 | Sidelman | 24/450 |
| 3,527,001 | 9/1970 | Kleemeier et al. | 24/446 X |
| 3,913,183 | 10/1975 | Brumlik | 24/442 X |
| 4,041,549 | 8/1977 | Atkinson | 24/450 X |
| 4,169,303 | 10/1979 | Lemelson | 24/446 X |
| 4,290,174 | 9/1981 | Kalleberg | 24/444 |
| 4,615,084 | 10/1986 | Erb | 24/442 |
| 4,617,214 | 10/1986 | Billarant | 24/444 X |

FOREIGN PATENT DOCUMENTS

| | | | |
|---|---|---|---|
| 754302 | 10/1970 | Belgium | 24/442 |
| 0037652 | 10/1981 | European Pat. Off. . | |
| 211564 | 2/1987 | European Pat. Off. | 24/442 |
| 1610318 | 10/1970 | Fed. Rep. of Germany . | |
| 3244410 | 10/1983 | Fed. Rep. of Germany . | |
| 1530822 | 5/1968 | France . | |

*Primary Examiner*—Laurie K. Cranmer

*Attorney, Agent, or Firm*—Oblon, Spivak, McClelland, Maier & Neustadt

[57] ABSTRACT

Described herein is a male fastener strip having a multitude of hooking elements on one side of substrate cloth, which is characterized in that the individual hooking elements are spaced from adjacent hooking elements by X(mm) and Y(mm) in the transverse and longitudinal directions of the fastener strip, respectively, such that X is between 2.0 and 4.0 mm, inclusive and X/Y is in the range of 0.5 to 3.5.

15 Claims, 2 Drawing Sheets

SEPARABLE FASTENER

This application is a continuation of application Ser. No. 07/071,378, filed on July 9, 1987, now abandoned.

BACKGROUND OF THE INVENTION

1. Field of the Invention

This invention relates to a separable fastener which is provided with a multitude of hooking elements on a substrate cloth.

2. Description of the Prior Art

There have thus far been known face-contacting separable fasteners which consist of a male fastener component having a multitude of upright hooking elements on one side of a substrate cloth and a female fastener component having a multitude of loop elements distributed on a contacting side of its substrate cloth for disengageably engaging with the hooking elements on the male fastener component. In most cases, for forming the male or hooking fastener component, firstly loops are formed by using monofilaments as warps in the weaving process of the substrate cloth to obtain an elongated or broad male fastener strip. Then, in order to enhance the interlocking action of the male fastener component with the female fastener component, the loops are cut open by the so-called clipping method employing a cutter blade assembly which is provided with a fixed cutter blade between a couple of movable cutter blades, to form hooks which are each opened by a clipped space of a width corresponding to the thickness of the intermediate fixed cutter blade. Although many of known male fastener components are made by this method, it is the general practice to narrow the intervals of the individual hooks to increase the number of the hooks in the transverse or longitudinal direction of the fastener for the reason that a greater hook density will increase the chances of engagement between the hook and loop elements. As a matter of fact, a study on the currently available male fastener components could not find any article which had hook elements at intervals greater than about 1.6 mm.

However, the conventional male fastener strips have drawbacks that they are hard in texture and that the small pitch hook-forming cutter blades which are used in the manufacturing process are apt to be blocked with the loop fragments which are clipped off to form the void spaces in the hooks, resulting in failure in clipping the loops appropriately or in undesirably impaired appearance. In addition, the positions of the void spaces in the individual hooks are extremely deviated to one side in the longitudinal direction of the fastener.

Therefore, a male fastener component with such a construction has a problem that the coupling rate is varied depending upon the direction of engagement when the fastener is brought into face-to-face engagement with a female or loop fastener component, showing a different coupling strength depending upon the direction of engagement. It follows that, when such a separable fastener is attached as a joining or connecting member to articles of apparel, shoes, seat covers, or the like, it is necessary to pay attention to the fastener mounting direction—although discrimination of the fastener mounting directions is difficult in some cases. Particularly, it is unsuitable for application to shoes, gloves, diapers, belts or other articles which require a coupling force in one lateral direction. The fastener has another drawback that its stiffness is incongruous with an apparel or cloth of fine texture if used as a fastener therefor.

OBJECT OF THE INVENTION

It is an object of the present invention to provide a male fastener component which is smaller in directional variations of the coupling force when engaged face-to-face with a female fastener component than previously known male fastener components, and which is soft in texture.

SUMMARY OF THE INVENTION

In accordance with the present invention, the above-mentioned object is achieved by the provision of a male fastener component having a multitude of hooking elements on one side of a substrate cloth, in which the individual hooking elements are formed at intervals of X(mm) in the transverse direction and at intervals of Y(mm) in the longitudinal direction, the value of X being between 2.0 to 4.0 mm, inclusive, and the ratio X/Y being in the range of 0.5 to 3.5, inclusive.

The hooking elements which constitute the male fastener component of the present invention can be formed by weaving monofilaments of nylon, polyester or other arbitrary synthetic resin fibre as auxiliary warps into the substrate cloth in the weaving process of the latter to form outwardly projecting loops on a surface of the cloth and clipping the loops into a hook shape. In order to fix the leg portions of the hooking elements which are formed on one side of the substrate cloth, normally a synthetic resin such as polyurethane or the like is coated on the other side of the substrate cloth.

The hooking fastener component according to the present permits the broadening of the pitches in the transverse direction of the teeth of the fixed blades and upper and lower movable blades to be used for clipping the loops into a hook shape, as well as the pitch of the grooves between the respective clipping blade teeth, precluding blocking of the grooves by the fragments of the clipped loop portions. Therefore, it is possible to form hooks which have in one leg portion thereof a clipped portion of a width corresponding to the thickness of the fixed blade. Accordingly, the male fastener component according to the invention has an advantage that the directional variations of the coupling force are extremely small. Besides, since the intervals between adjacent hooking elements in the transverse direction of the substrate cloth of the fastener are broadened, a given number of hooking elements per unit area can be formed by the use of a reduced number of monofilaments as compared with the conventional counterparts, softening the texture of the fastener and permitting reduction of its production cost.

Shown at (1) of FIG. 1 is the manner of forming hooks on a substrate cloth by means of the clipping method, and at (2) is the conventional method of forming hooks on substrate cloth by a similar clipping method. In these drawings, the reference numeral 1 indicates hooking elements, the reference numeral 2 indicates fixed cutter blades, and the reference numeral 3 indicates movable cutter blades.

The expression "intervals (X) between adjacent hooking elements in the transverse direction" as used in this specification means the distance between a point of the substrate cloth which constitutes a longer leg of a hook and a point of the substrate cloth which constitutes a longer leg of a hook which is located adjacently in the widthwise direction (i.e. in the direction of the array of hooks extending across the width of the substrate cloth or parallel with the weft yarns). The expression "intervals (Y) between longitudinally adjacent hooking elements" means the distance between a point of the substrate cloth which constitutes a longer leg of a hook and a point of the substrate cloth which constitutes a longer leg of a hook which is located adjacently in the longitudinal direction (i.e. in the direction of the row of hooks extending in the longitudinal direction of the cloth or parallel with the warp yarns).

In accordance with the present invention, it is necessary to fulfill simultaneously the conditions of X=2.0 to 4.0 mm and X/Y=0.5 to 3.5. Accordingly, even if the ratio of X/Y is in the range of 0.5–3.5, the pitch of the hook-clipping cutter blades is minimized unless the value of X is greater than 2.0 mm, increasing the possibilities of blockage of the cutting blades with the fragments of the clipped loop portions or failing to clip the loops to a material degree to cause directional irregularities in coupling strength when engaged face-to-face with a female fastener component. On the other hand, when the value of X is greater than 4.0 mm, the number of the hooking elements per unit area of the substrate cloth becomes too small, resulting in a lower coupling strength with the female fastener and instable hook conditions. More preferably, the value of X is in the range of 2.7–2.9 mm, and the ratio X/Y is in the range of 0.9–1.6. Where the values of X and X/Y are set in these ranges, it is possible to obtain a fastener which has less directional irregularities in coupling strength and which is soft in texture—that is to say, a fastener which is well-balanced in terms of coupling strength and disposition of the hooking elements. With regard to the value of Y, normally it is selected arbitrarily from a range of 0.6–4.0 mm.

The hooking elements on the fastener according to the present invention may be arranged in any pattern as long as they are arrayed regularly at certain intervals in the transverse and longitudinal directions of the substrate cloth. However, in case of a fastener which has two variations in the transverse intervals (X) of the hooking elements or two variations in the longitudinal intervals (Y), it is a mandatory requisite that the values of X and X/Y are in the above-defined ranges. Examples of arrangements of the hooking elements are shown in FIGS. 2(1) to 2(6), in which X'-X'' and Y'-Y'' indicate the transverse and longitudinal directions of the fastener component, respectively, and X1 to X9 and Y1 to Y9 indicate the transverse and longitudinal intervals of the hooking elements, respectively.

In accordance with the invention, the height of the hooking elements is preferred to be in the range of 1–5 mm, and the inside diameter of the loops is preferred to be in the range of 0.1–1 mm. Further, the hooking elements are preferred to be arranged on the substrate cloth in a density of 20–70 hooks/cm$^2$.

The female fastener component to be used in face-to face engagement with the male fastener component according to the invention may carry the loop elements in any arrangement or pattern as long as it will not impair the functional characteristics of the fastener.

DESCRIPTION OF PREFERRED EMBODIMENTS

Hereinafter, the invention is illustrated more particularly by way of examples, but it is to be understood that the invention is not restricted to the specific examples given.

EXAMPLE AND COMPARATIVE EXAMPLE 1

Figure 1:
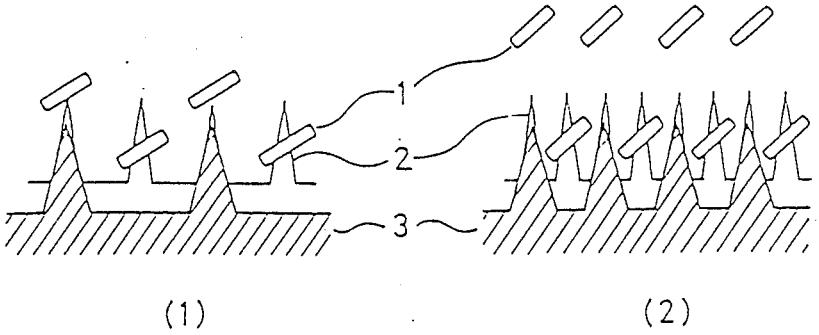
FIG. 1 is a schematic illustration explanatory of the manner of forming hooks on substrate cloth by a clipping method, showing at (1) a male fastener component according to the invention and at (2) a conventional counterpart.
Figure 2:
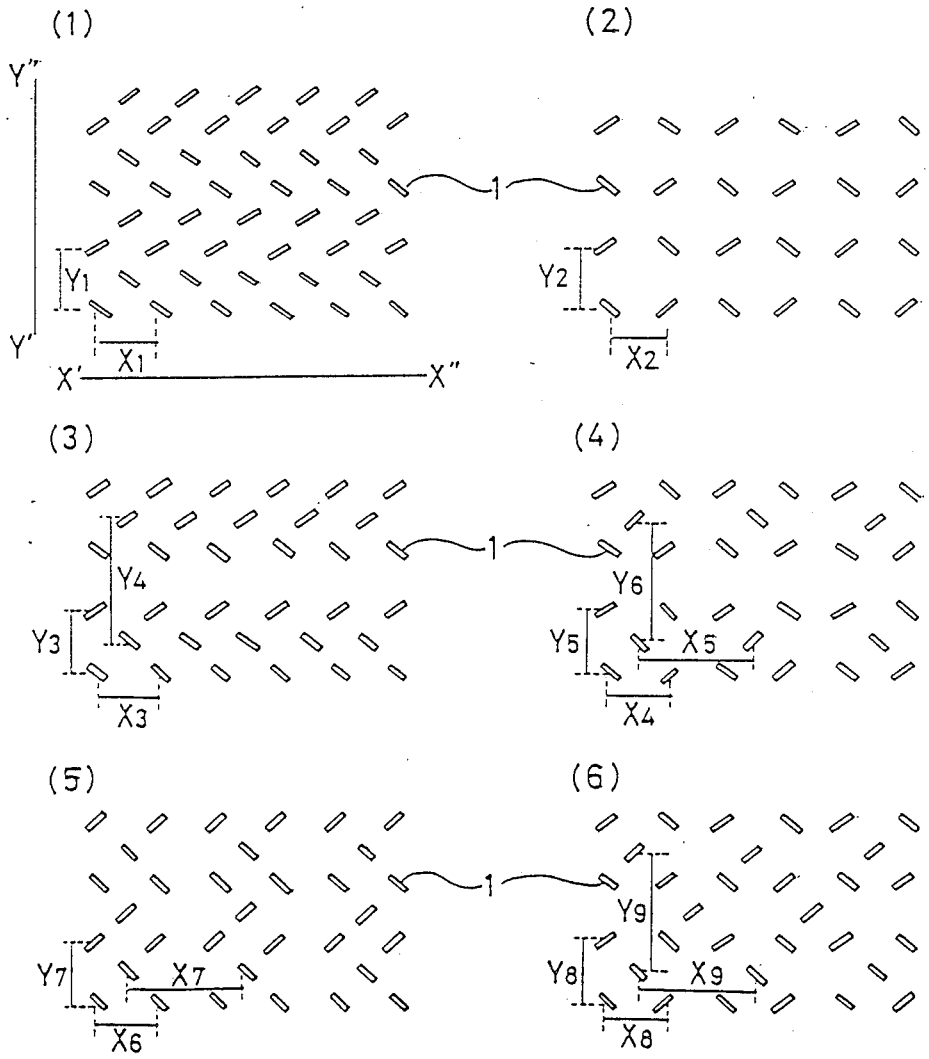
FIG. 2 is a schematic illustration giving examples of the arrangement of the hooking elements of the male fastener component according to the invention, in which X'-X'' and Y'-Y'' indicate transverse and longitudinal directions of the fastener component, respectively, and X1–X9 and Y–Y9 indicate transverse and longitudinal intervals of the hooking elements.

Substrate cloth specimens having loops arranged as shown at (1) of FIG. 1 with intervals of 2.7–2.9 mm in a direction parallel with the wefts (in the transverse direction of the fastener) and intervals of 1.9–2.1 mm in a direction parallel with the warps (in the longitudinal direction of the fastener) and a loop height of 1.8–2.0 mm were woven, using nylon 110 denier/24 filaments as ground warp yarns, nylon 110 denier/24 filaments as ground weft yarns, and 330 denier nylon monofilament as looping wefts (all products of Toray Industries, Inc.). Then, the substrate cloth specimens were thermally set for 13 seconds at 230° C. for shape retention, and a solvent type urethane resin ("Urethane 300", a product of Nippon Oil & Fats Co., Ltd.) was coated on the back side of each specimen (i.e., on the loop-free side) at a rate of 40 g/m$^2$ dry. After drying, one end of each loop of the substrate cloth was clipped off by the use of a 1.4 mm pitch fixed blade and 2.8 mm pitch upper and lower movable blades to obtain male fastener components having X=2.7–2.9 mm, X/Y=1.28–1.53, and a hook density per unit area of 33–36 loops/cm$^2$.

The male fastener components thus obtained were tested for coupling strength with a female fastener (B1000 Magic Tape (trademark) of Kuraray Co., Ltd.) at a tensile speed of 300 mm/min by the use of Shimazu Autograph (a product of Shimadzu Corporation). The results are shown in Table 1, in which the coupling strength (shearing strength) indicates a strength for an area of engagement of 25 mm (width×50 mm (length), and the strengths (1) and (2) indicate a strength when the fastener is pulled in the longitudinal direction and a strength when the fastener is pulled in the opposite direction, respectively.

During and after a loop clipping operation which was continued for 8 hours, the grooves between the fixed clipping blades were completely free of blockage by clipped loop fragments. Clipping or cutting failures as well as the blockage of the fixed blade grooves did not occur even in high speed clipping operations.

For the purpose of comparison, substrate cloth specimens with loops at intervals of 1.39–1.41 mm in a direction parallel with the weft yarns and at intervals of 3.9–4.1 mm in a direction parallel with the warp yarns were woven from the same nylon materials and by the same method and procedures as described above. The loops on the substrate cloth were clipped by means of 0.7 mm pitch fixed blades and 1.4 mm pitch upper and lower blades to obtain male fastener components with X=1.39–1.41 mm, X/Y=0.33–0.37, and a hook density per unit area of 33–36 hooks/cm$^2$. The coupling strength was measured in the same manner as described above. The results are also shown in Table 1.

In this case, the grooves between the fixed blades were blocked with clipped loop fragments up to about ½ of the depth of the respective grooves already in about 10 minutes after starting the loop clipping operation. In addition, there were observed trends of loop clipping failures and irregularities in hook shape, and especially these trends became conspicuous in high speed clipping operations.

Comparison of the male fastener components of Example 1 with those of Comparative Example 1 revealed that the former showed less directional variations of the coupling strength, permitted a saving of the loop monofilament by about 25%, and were softer in texture by about 20%.

EXAMPLES 2-4 AND COMPARATIVE EXAMPLES 2-4

Male fastener components were prepared in the same manner as in Example 1 except for various variations of the distances of the loop intervals in the directions parallel with the warps and wefts and of the material for the substrate cloth. Their coupling strengths were measured in the same manner as in Example 1. The results are also shown in Table 1.

TABLE 1

| | Example 1 | Example 2 | Example 3 | Example 4 | Comparative Example 1 | Comparative Example 2 | Comparative Example 3 | Comparative Example 4 |
|---|---|---|---|---|---|---|---|---|
| Fabric Material | | | | | | | | |
| Ground Warps | Nylon 66 110d/24f | Nylon 6 110d/30f | Polyester 100d/20f | Polyester 100d/20f | Nylon 66 110d/24f | Nylon 6 110d/30f | Polyester 100d/20f | Polyester 100d/20f |
| Ground Wefts | Nylon 66 110d/24f | Nylon 6 110d/30f | Polyester 100d/20f | Polyester 100d/20f | Nylon 66 110d/24f | Nylon 6 110d/30f | Polyester 100d/20f | Polyester 100d/20f |
| Looping Warp Yarns | Nylon 66 330d | Nylon 6 350d | Polyester 470d | Polyester 600d | Nylon 66 330d | Nylon 6 350d | Polyester 470d | Polyester 600d |
| X (mm) | 2.7-2.9 | 2.7-2.9 | 2.8-3.1 | 2.8-3.1 | 1.39-1.41 | 1.39-1.42 | 1.39-1.42 | 1.39-1.43 |
| Y (mm) | 1.9-2.1 | 1.9-2.1 | 2.8-3.1 | 2.8-3.1 | 3.9-4.1 | 4.0-4.1 | 4.2-4.5 | 4.2-4.5 |
| X/Y | 1.28-1.53 | 1.28-1.53 | 0.90-1.11 | 0.90-1.11 | 0.33-0.37 | 0.34-0.36 | 0.31-0.34 | 0.30-0.34 |
| Number of Hooks per Unit Area (hooks/cm$^2$) | 33-36 | 33-36 | 30-33 | 30-33 | 33-36 | 33-36 | 30-33 | 30-33 |
| Coupling Strength 1 | 11.0 | 10.5 | 14.0 | 20.0 | 12.0 | 11.0 | 16.0 | 22.0 |
| (kg) 2 | 11.0 | 10.5 | 14.0 | 20.0 | 9.0 | 8.0 | 12.0 | 18.0 |
| Stiffness* (mm) | 44 | 46 | 41 | 41 | 37 | 38 | 33 | 33 |
| Consumption of Looping Yarns (g/m$^2$) | 80 | 88 | 128 | 164 | 108 | 116 | 172 | 220 |

* Measured by the heart-loop method according to Japanese Industrial Standards (JIS-L-1096-79')

What is claimed is:

1. A male fastener strip:
(a) having a multitude of hooking elements on one side of a substrate cloth woven from nylon or polyester yarn;
(b) possessing the capability of repeated engagements of interlocking and unlocking to a female fastener strip having loop elements;
(c) said hooking elements being formed by a weaving process on one side of said substrate cloth; and
(d) said hooking elements being spaced from adjacent hooking elements by X(mm) and Y(mm) in the transverse and longitudinal directions of said substrate cloth, respectively, such that the value of X is between 2.7-2.9 mm, inclusive, and the ratio X/Y is between 0.9-1.6, inclusive, whereby:
(e) directional variations of the coupling force when engaged face-to-face with a female fastener strip are small and
(f) the male fastener strip is soft in texture.

2. The male fastener strip of claim 1, wherein said hooking elements have a height of 1-5 mm.

3. The male fastener strip of claim 1, wherein said hooking elements are formed on said substrate cloth in a density of 20-70 hooks/cm$^2$.

4. A male fastener strip:
(a) having a multitude of hooking elements on one side of a substrate cloth woven from nylon or polyester yarn;
(b) possessing the capability of repeated engagements of interlocking and unlocking to a female fastener strip having loop elements;
(c) said hooking elements being formed by a weaving process on one side of said substrate cloth; and
(d) said hooking elements being spaced from adjacent hooking elements by X(mm) and Y(mm) in the transverse and longitudinal directions of said substrate cloth, respectively, such that the value of X is between 2.7 and 2.9 mm, inclusive, and the ratio X/Y is in the range of 0.5-3.5, whereby:
(e) directional variations of the coupling force when engaged face-to-face with a female fastener strip are small and
(f) the male fastener strip is soft in texture.

5. The male fastener strip of claim 4, wherein X/Y is between 0.9-1.6, inclusive.

6. The male fastener strip of claim 4, wherein said hooking elements have a height of 1-5 mm.

7. The male fastener strip of claim 4, wherein said hooking elements are formed on said substrate cloth in a density of 20-70 hooks/cm$^2$.

8. A male fastener strip:
(a) having a multitude of hooking elements on one side of a substrate cloth woven from nylon or polyester yarn;
(b) possessing the capability of repeated engagements of interlocking and unlocking to a female fastener strip having loop elements;

(c) said hooking elements being formed by a weaving process on one side of said substrate cloth; and (d) said hooking elements being spaced from adjacent hooking elements by X(mm) and Y(mm) in the transverse and longitudinal directions of said substrate cloth, respectively, such that the value of X is between 2.7 and 3.1 mm, inclusive, and the ratio X/Y is in the range of 0.5-3.5, whereby:

(e) directional variations of the coupling force when engaged face-to-face with a female fastener strip are small and (f) the male fastener strip is soft in texture.

9. The male fastener strip of claim 8, wherein X is between 2.7–2.9 mm, inclusive, and X/Y is between 0.9–1.6, inclusive.

10. The male fastener strip of claim 8, wherein said hooking elements have a height of 1–5 mm.

11. The male fastener strip of claim 8, wherein said hooking elements are formed on said substrate cloth in a density of 20–70 hooks/cm$^2$.

12. A male fastener strip:

(a) having a multitude of hooking elements on one side of a substrate cloth woven from nylon or polyester yarn;

(b) possessing the capability of repeated engagements of interlocking and unlocking to a female fastener strip having loop elements;

(c) said hooking elements being formed by a weaving process on one side of said substrate cloth; and (d) said hooking elements being spaced from adjacent hooking elements by X(mm) and Y(mm) in the transverse and longitudinal directions of said substrate cloth, respectively, such that the value of X is between 2.7 and 4.0 mm, inclusive, and the ratio X/Y is in the range of 0.5–3.5, whereby:

(e) directional variations of the coupling force when engaged face-to-face with a female fastener strip are small and (f) the male fastener strip is soft in texture.

13. The male fastener strip of claim 12, wherein X is between 2.7–2.9 mm, inclusive, and X/Y is between 0.9–1.6, inclusive.

14. The male fastener strip of claim 12, wherein said hooking elements have a height of 1–5 mm.

15. The male fastener strip of claim 12, wherein said hooking elements are formed on said substrate cloth in a density of 20–70 hooks/cm$^2$.

* * * * *